United States Patent [19]

Ploeg et al.

[11] 4,444,263

[45] Apr. 24, 1984

[54] PERMANENT THERMAL PACKER METHOD

[75] Inventors: Johan F. Ploeg, Fullerton; Arlo L. Oden, Bakersfield, both of Calif.

[73] Assignee: Chevron Research Company, San Francisco, Calif.

[21] Appl. No.: 487,790

[22] Filed: Apr. 22, 1983

Related U.S. Application Data

[62] Division of Ser. No. 288,258, Jul. 29, 1981, Pat. No. 4,403,656.

[51] Int. Cl.[3] ..... E21B 33/13

[52] U.S. Cl. ..... 166/285; 166/302; 166/387; 166/DIG. 1

[58] Field of Search ..... 166/57, 114, 116, 121, 166/179, 181, 285, 289, DIG. 1, 185, 303, 288, 290, 387, 302

[56] References Cited

U.S. PATENT DOCUMENTS

| | | | |
|---|---|---|---|
| 3,131,767 | 5/1964 | Chancellor et al. | 166/289 |
| 3,208,521 | 9/1965 | Holland et al. | 166/285 |
| 3,561,531 | 2/1971 | Miller | 166/285 |
| 3,971,441 | 7/1976 | Knowles et al. | 166/DIG. 1 |
| 4,326,586 | 4/1982 | Wilder | 166/285 |
| 4,333,530 | 6/1982 | Armstrong | 166/289 |

*Primary Examiner*—Stephen J. Novosad
*Assistant Examiner*—William P. Neuder
*Attorney, Agent, or Firm*—Edward J. Keeling; D. A. Newell; Lewis S. Gruber

[57] ABSTRACT

A permanent thermal packer is disclosed for sealing the annulus between an injection tubing string and a well casing. The packer is thermal cement and is placed from within the injection tubing string to seal a substantial portion of the annulus above the injection zone. The packer provides a means for sealing the annulus above the injection zone thus permitting insulating material to be placed in the annulus above the packer with the expectation that it will not be damaged by well bore fluids.

1 Claim, 6 Drawing Figures

PERMANENT THERMAL PACKER METHOD

This is a division of application Ser. No. 288,258, filed July 29, 1981 now U.S. Pat. No. 4,403,656.

This invention relates to a permanently placed packer in a cased well. The packer of this invention is placed between the casing in the well and an internal concentric tubing string passing through the cased well.

BACKGROUND OF THE INVENTION

When boreholes are drilled to recover oil or gas the well casing dropped into the hole is usually cemented to the formation at or near the lower end of the hole, and at other locations along the casing. In cementing the casing to the formation the formation is sealed to the casing in the annulus outside of the casing. Production from the oil well or gas well is through perforations in the casing and cement, into the casing and then upward to the wellhead.

In the production of heavy viscous crudes which require some form of modification to the crude itself in the subsurface in order to make it producible into a casing, it has become necessary to seal the inside of the cased well so as to establish a zone within the cased well through which materials may be pumped from the casing into the formation. In the typical operation, an expandable packer is placed on the end of a packer-placing or injection tubing and the packer is expanded to completely seal the annulus between the casing and the placing or injection tubing.

When steam or hot liquids are the material that is being pumped into the formation, the expandable packer is less desirable and ineffective because expandable materials are incapable of sustaining the desired seal when the injection temperatures are 300° F. and higher and the injection pressures can be of the order of 2000 to 2500 pounds per square inch. Alternative means for sealing the annulus along the cased well are, therefore, needed in the event that the fluids pumped into the well are at high temperatures and pressures.

SUMMARY OF THE INVENTION

In accordance with the present invention, it is proposed to place a permanent cement packer in the annulus along the steam injection well between the inside of the casing of the well and the outside of the steam injection tubing. It is a further objective of the present invention to place the permanent cement packer in the well while the steam injection tubing string is in position. A further objective of the present invention is to establish a permanent placement of material in the annulus around the injection string, the material being capable of accomplishing the desired sealing of the annulus at the placement location at the elevated temperatures and pressures expected when injection fluids, for instance, steam, are injected into a viscous crude containing formation.

Other objects and features of the present invention will be readily apparent to those skilled in the art from the appended drawings and specificaton illustrating a preferred embodiment wherein.

Figure 1:
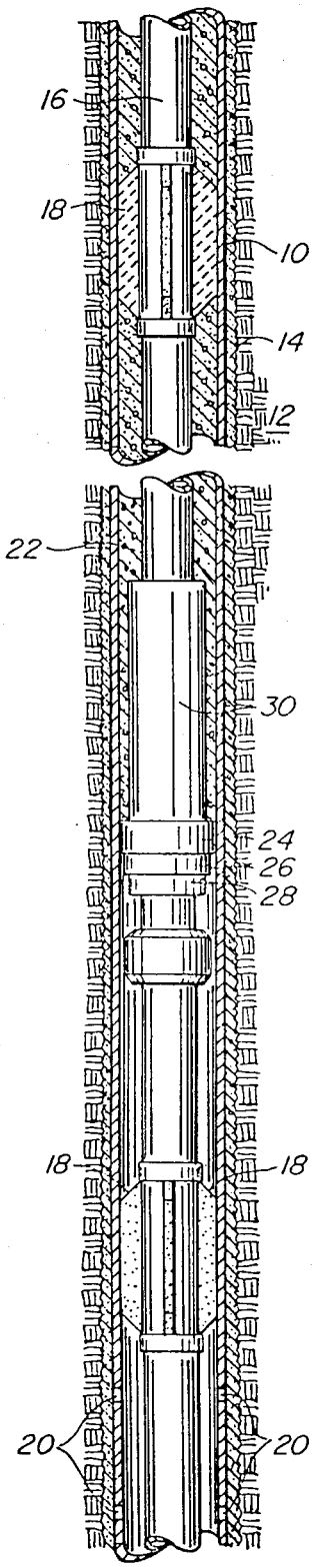
FIG. 1 is a sectional view through an earth formation illustrating a casing cemented in place in engagement with the formation and showing a conductor string passing through the interior of the casing with a permanent packer of the present invention placed within the casing.

FIG. 1 of the drawings illustrates a well casing 10 passing through a formation 12 and secured to the formation at the outside of the casing by conventional cementing materials 14. A centralized tubing string 16 is positioned within the casing and centralized by centralizers 18. At or near the earth's surface centralizers are used on about each third tubing section. About mid well the centralizers are on every other section, and near the location where the packer is to be placed each section has a centralizer. The casing is perforated at 20 to provide exit ports into the formation for the hot fluids pumped down the interior of the centralized tubing string. Above the perforations, a permanent packer 22 is placed to fill the annulus between the exterior of the tubing string and the interior of the casing. The bottom end of the packer is defined by a frangible, flexible packer 24 having suitable backup washers 26 and locking bolt 28. Above the flexible packer 24 is the permanent packer-placing tool 30 which provides a means for positioning the material for packer 22 in the annulus surrounding the tubing string.

In accordance with the present invention, the permanent packer material is preferably a cement that can withstand the elevated temperatures of injection steam or other hot fluids and is placed in the annulus in a fluid form where it is then permitted to set to form the desired sealing of the annulus. A material of choice for the permanent packer is a calcium aluminate cement and the packer itself is placed for a substantial inyterval along the annulus. In the case of a typical steam injection well, the casing would be of the order of 7 inches in diameter and the calcium aluminate cement packer would be placed over an interval of between 30 and 90 feet and usually approximately 60 feet of the annulus. It is desirable to form the cement permanent packer around at least one and perhaps more centralizers along the well bore. In that manner, it will be assured that the tubing string is maintained in a centralized position along the annulus and particularly at the packer. It is further desirable to fill the annulus above the packer with insulating materials. Such materials may be poured down the well bore from the surface to form the desired insulation between the centralized tubing string and the cemented casing. One such insulating material is pearlite and other forms of materials that will withstand the subsurface conditions along the well bore may be used in this insulating function.

While a single flexible packer 24 has been illustrated at the bottom end of the ported cementing tool, it should be understood that several such packers may be positioned to insure that the cementing material does not flow downwardly around the flexible packer to become lost or to cause damage to the perforated injection interval along the lower portion of the well.

A means for accommodating expansion of the tubing string between the fixed end at the packer and the wellhead is needed. The tubing will expand in length when the hot fluid is pumped into the well. Such an expansion may be accommodated with a conventional expansion joint along the tubing or with a wellhead configuration as shown in copending application of G. W. Anderson and S. O. Hutchison, Ser. No. 284,747, filed, July 20, 1981.

Figure 2:
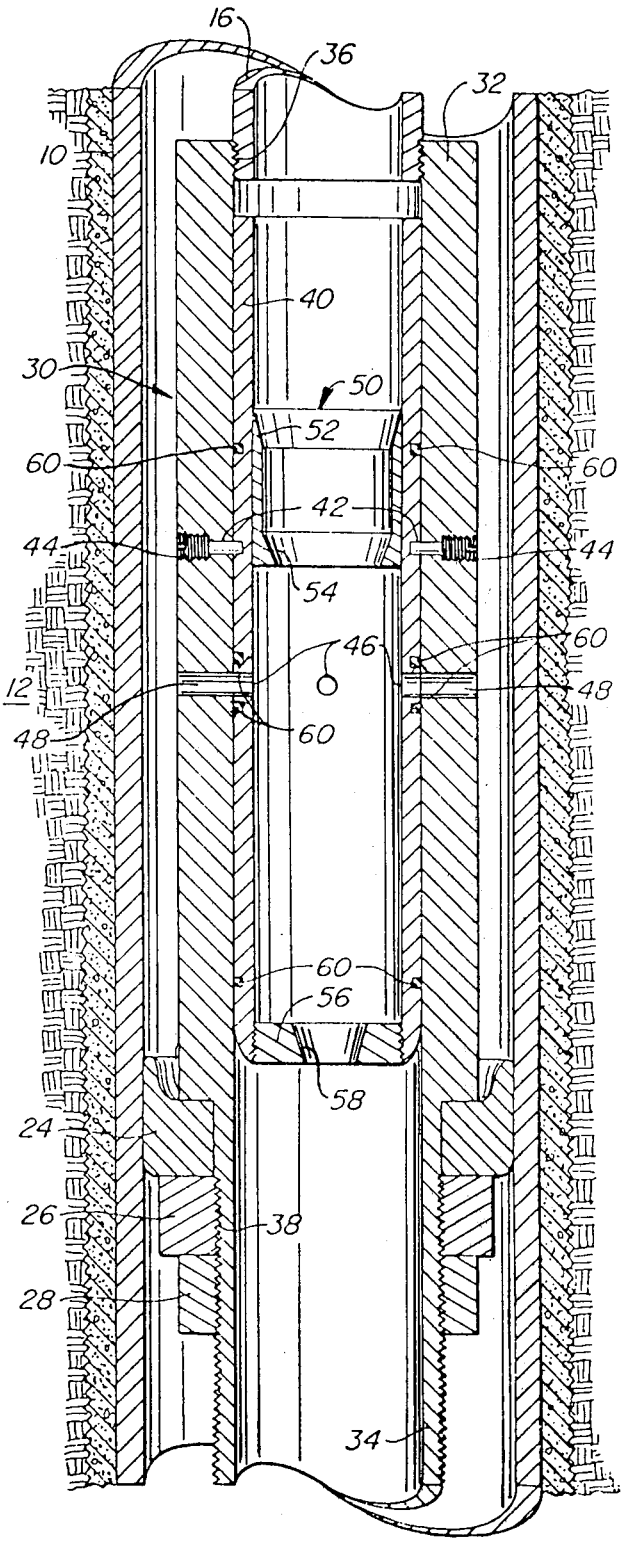
FIG. 2 is a sectional view through the casing and internal tubing illustrating a form of apparatus for placing the permanent packer of the present invention in the annulus between the casing and the tubing.

FIG. 2 is an enlarged sectional view through the cementing tool 30 illustrating the tool in place along the interior of the cased well prior to the placement of the packer cement material. The cementing tool constitutes an external tubular portion 32 having a threaded lower extension 34. The upper end of the tubular portion 32 is threaded at 36 to receive the threaded male end of a centralized tubing string section and in that manner is supported on the end of the tubing string. The lower end of the cementing tool is threaded at 38 to provide a means for securing the frangible flexible packer 24 and its backup washer 26 by the locking bolt 28 which engages the threads 38 on the tool. More than one flexible packer 24 may be installed along the injection string to accomplish the desired annulus seal.

A tubular sliding sleeve 40 is positioned within the tubular portion 32 of the cementing tool. The sliding sleeve is held in place by shear pins 42 which are inserted in a hole through the tubular portion and held in place by suitable locking screws 44. When locked in position by shear pins 42 the sliding sleeve has its exit ports 46 in alignment with exit ports 48 through the collar 32. When so aligned, the ports 46 and 48 provide an injection port through the entire assembly from the inside of the cementing tool to the annulus outside the cementing tool.

On the inside of the collar, above the exit ports 46 and 48, a formed seat is permanently fixed to the inside surface of the collar. The seat 50 has a first shoulder 52 and a lower narrower shoulder 54 whose functions will become apparent as the operation of the cementing tool is described. At the lower end of the cementing tool and at the interior of the collar, the seat forming plug 56 is positioned and a centralized tapered hole 58 is drilled through the plug to establish the desired seating surface.

A series of O-rings 60 are placed along the exterior surface of the sleeve 40 to provide seals between the collar and the sleeve along the tool.

Figure 3:
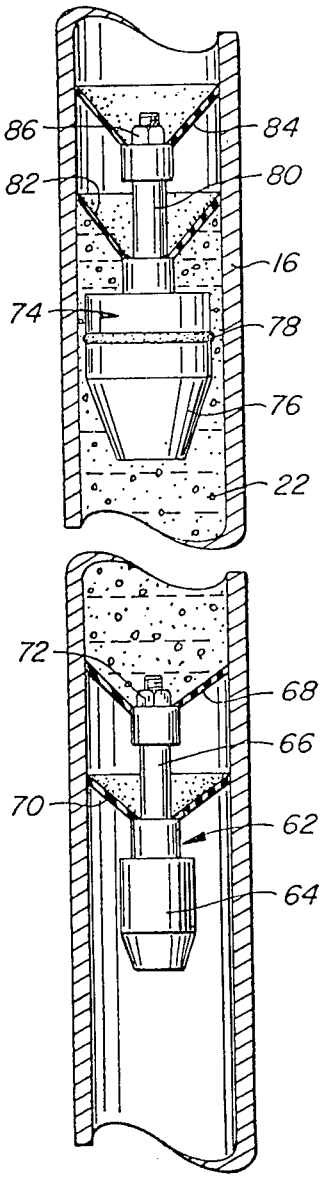
FIG. 3 is a sectional view through a portion of the tubing string illustrating a manner for tranporting the material to be used for the permanent packer from the wellhead through the tubing string to the subsurface location.
Figure 4:
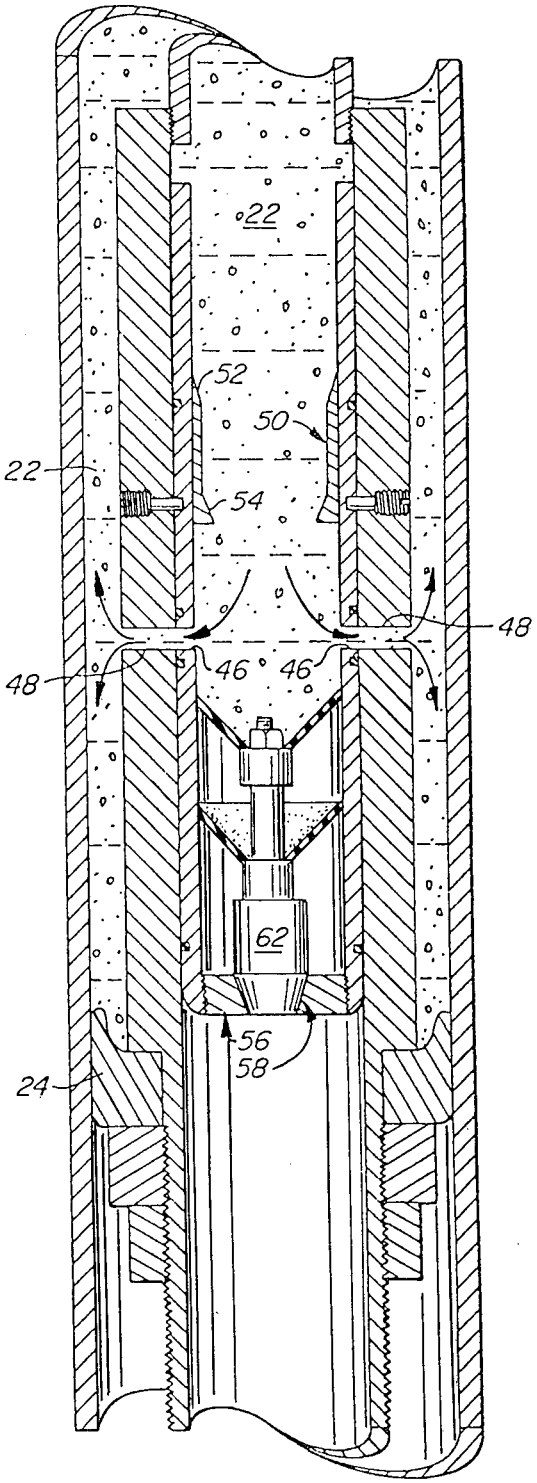
FIG. 4 is a sectional view through the packer placing tool and illustrating the placement of the packer material in the annulus surrounding the conductor tubing.
Figure 5:
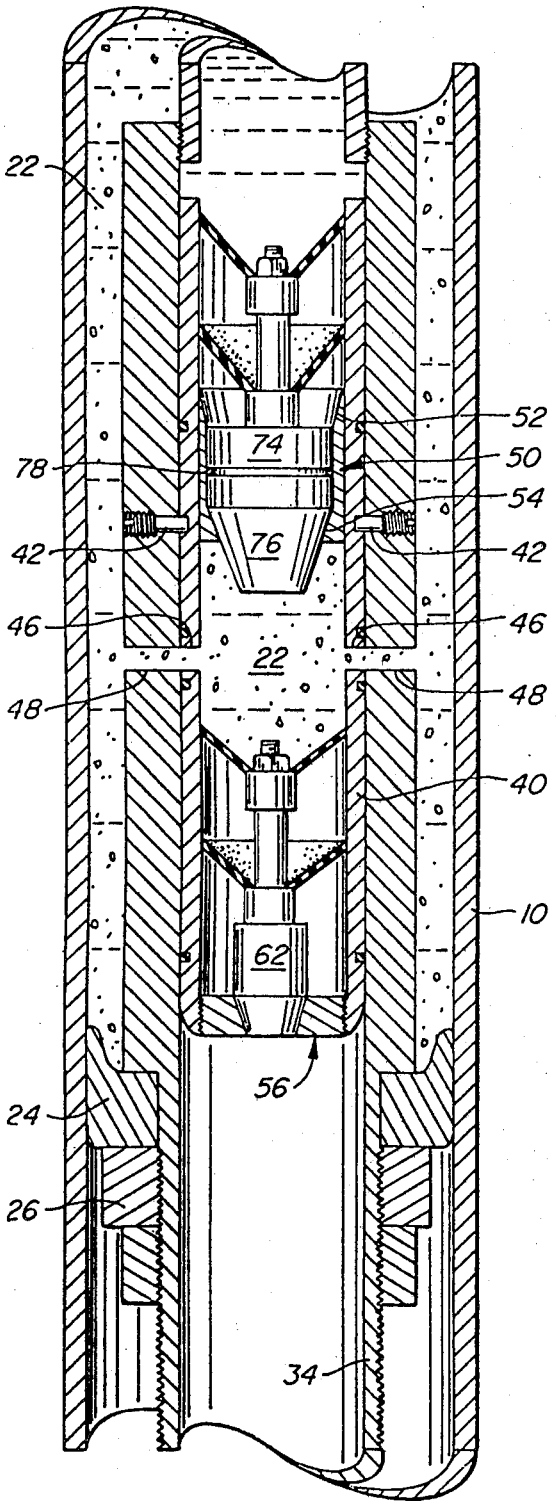
FIG. 5 is a sectional view illustrating the placement tool at the end of the placement of the packer material.

FIGS. 3, 4, 5 illustrate the procedure for placement of the permanent cement packer of the present invention into the annulus surrounding the cementing tool. FIG. 3 illustrates the slug of cementing material 22 in its liquid form being pumped down the tubing string 16 from the earth surface. FIG. 3 does not illustrate the casing as it forms no function for assisting in the explanation of the transport of the cementing material. As illustrated in FIG. 3, the lower end of the slug of cementing material 22 is held in place and then preceded by a separation plug 62 having a tapered head portion 64 and a central shaft 66. A pair of flexible cup collars 68 and 70 are attached to the central shaft 66 by threaded nut 72. The upper end of the slug of cementing material 22 is pushed along by a sealing plug 74 having a tapered head portion 76 and a body portion having an O-ring 78 with an upper central shaft 80. A pair of flexible cup collars 82 and 84 are held in place on shaft 80 by a nut 86.

Referring now to FIG. 4 wherein the cementing material 22 is shown in its positions of being pumped through the collar and into the annulus surrounding the cementing tool. The separation plug 62 has passed through the formed seat 50 and is now seated against the tapered hole 58 of the seat forming plug 56. It should be evident that the separation plug is dimensioned so that it may pass through the first shoulder 52 and the lower shoulder 54 of the formed seat 50. Having passed the ports 46 and 48 through the sleeve and collar respectively the separation plug is below those ports and the cementing material 22 flowing down the tubing string may pass outwardly through the ports and into the annulus surrounding the cementing tool. The initial portion of the cementing material passing through ports 46 and 48 should flow downwardly along the annulus until it encounters the flexible packer 24 and will thereafter flow upwardly along the annulus to fill the area above the cementing tool.

Referring now to FIG. 5 wherein is illustrated the position of the separation plug 62 in contact with the seat forming plug 56 and the sealing plug 74 in contact with the formed seat 50 below the first shoulder 52 and above the lower shoulder 54, the O-ring 78 along the body of the sealing plug provides a seal between the sealing plug and the formed seat while the tapered head portion 76 provides a firm seat against the lower shoulder 54. With the separation plug 62 and sealing plug 74 in place against the seat 50 and plug 56, the full slug of cementing material 22 has been pumped into the inside of the cementing tool and through the ports 46 and 48 to fill the annulus between the cementing collar and the inside of the casing 10.

The collar is permitted to sit in this position with the plug in place until the cementing material is completely formed to produce the desired permanent thermal packer in the annulus. The plug 74 is held in place by pressure applied from the wellhead. That pressure may be the hydraulic pressure of a liquid standing in the inside of the tubing string or from an air column under pressure in the string.

Figure 6:
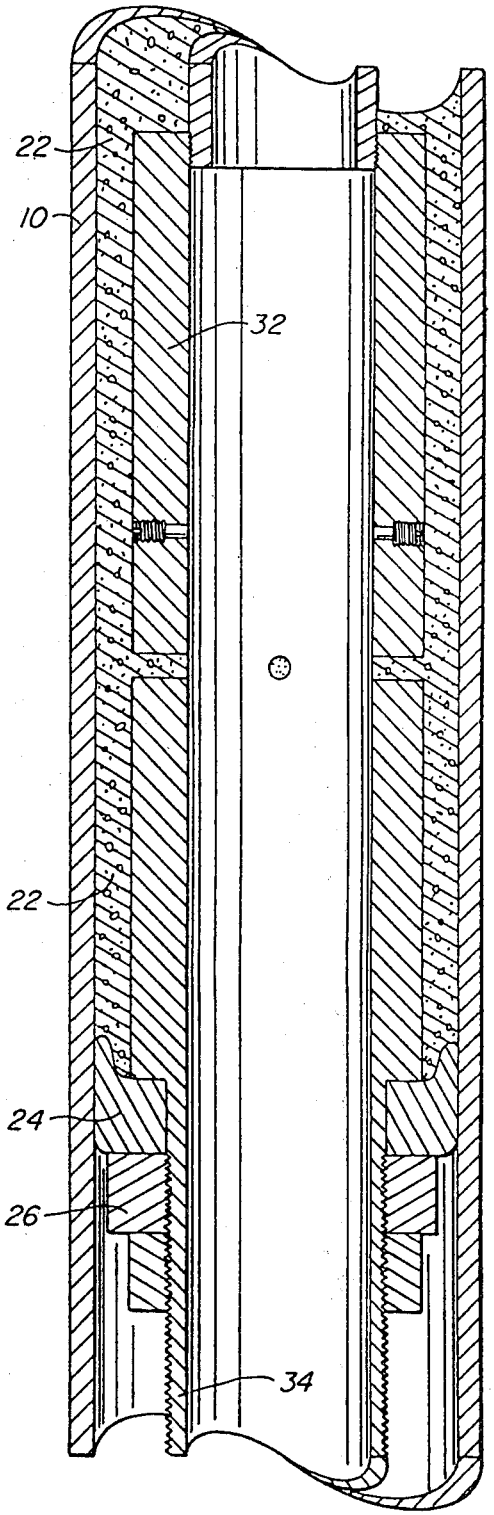
FIG. 6 is a sectional view through the tubing and casing and showing the permanent packer in place in the annulus surrounding the conductor tubing.

Referring now to FIG. 6 where the completed thermal cement packer is shown with a portion of the cementing collar removed. The sliding sleeve 40 is removed from the inside of the cementing collar 32 by increasing the pressure on the column within the tubing string to apply enough pressure to the sealing plug 74 to force the sleeve to shear both the shear pins 42 and the small tubular portion of cementing material in the ports 46 and 48 and to cause the sleeve to flow downwardly through the threaded lower extension of the cementing tool, into the tubing string and into the well below the desired injection interval, frequently referred to the "rat hole" below the perforations. The remaining set cement material forms a permanent thermal cement packer 22 completely filling the annulus between the casing and the cementing collar and providing a complete seal between the injection interval below the packer and the annulus above the packer.

With a permanent cement packer placed in the formation or in the annulus around the tubing string, the high temperatured fluids such as steam may be injected into the formation without doing damage to the packer. Furthermore, the interior of the injection string is a smooth continuous surface permitting workover tools to be run into and beyond the cement packer. Should it become necessary to remove the injection string, it is only then necessary to run an external drill tool down the outside of the tubing string to grind up the cement packer and produce a clean well along the inside the casing. The frangible flexible packer 24 and the cement packer 22 are adapted to be completely drillable to flow up the annulus with drilling muds or other fluid materials to clean out the well. The space around the outside of the cementing tool provides an adequate amount of space for such a drilling tool to pass to completely relieve the the otherwise permanent packer and permit the tubing string to be withdrawn for replacement or other workover within the well bore.

The annulus above the placed thermal packer should be filled with insulating material to reduce the heat loss from the injection string to the casing and formation above the injection interval. The packer of the present invention permits the use of insulating material such as pearlite because the packer maintains a complete seal of the annulus preventing liquids from entering the annulus to destroy the insulating quality of the insulating material.

While a certain preferred embodiment of the invention has been specifically disclosed, it should be understood that the invention is not limited thereto as many variations will be readily apparent to those skilled in the art and the invention is to be given its broadest interpretation within the terms of the following claims.

We claim:

1. A method for completing a hot fluid injection well along a cased outer conductor above a subsurface zone along said well into which said hot fluid is to be injected comprising the steps of:

(a) assembling at the wellhead a string of injection tubing;

(b) adding at least one upward facing, one-way packer to said injection tubing string;

(c) adding a ported cement collar to said injection string above said upward facing, one-way packer;

(d) running said assembled injection string into said cased outer conductor on the end of an inner well conductor;

(e) positioning said ported cement collar at the desired position along said well above said subsurface zone;

(f) flowing a liquid cement material down said inner well conductor, out said ported cement collar and into the annulus between said cased outer conductor and said inner well conductor and above said upward facing, one-way packer to fill said annulus along a substantial vertical length thereof;

(g) allowing said cement to set to produce a cement packer capable of withstanding temperatures higher than the temperature of said hot fluids to be injected and to produce a complete seal of said annulus above said upward facing one-way packer and along said substantial vertical length of said annulus;

(h) clearing the inside of said inner well conductor to provide access to said injection tubing and said subsurface zone along said inner conductor from said wellhead;

(i) and filling at least a portion of the annulus between the outside of said inner well conductor and the inside of said outer well conductor and above said cement packer with an insulating material to reduce heat loss from said inner well conductor to the earth formations along said well above said cement packer.

* * * * *